US008393308B2

(12) United States Patent
Kang et al.

(10) Patent No.: US 8,393,308 B2
(45) Date of Patent: Mar. 12, 2013

(54) SWITCHABLE CAM FOLLOWER OF A VALVE TRAIN OF AN INTERNAL COMBUSTION ENGINE

(75) Inventors: Bogyu Kang, Rochester Hills, MI (US); Xiaopo Ma, Troy, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 228 days.

(21) Appl. No.: 12/726,734

(22) Filed: Mar. 18, 2010

(65) Prior Publication Data

US 2010/0236507 A1 Sep. 23, 2010

Related U.S. Application Data

(60) Provisional application No. 61/161,679, filed on Mar. 19, 2009.

(51) Int. Cl.
*F01L 9/02* (2006.01)
*F01L 1/18* (2006.01)
*F01L 1/00* (2006.01)

(52) U.S. Cl. ..... 123/90.16; 123/90.44; 123/90.2; 123/90.47

(58) Field of Classification Search ..... 123/90.16, 123/90.44, 90.47, 90.2
See application file for complete search history.

(56) References Cited

U.S. PATENT DOCUMENTS

| | | | | |
|---|---|---|---|---|
| 5,544,626 | A | 8/1996 | Diggs et al. | |
| 6,901,894 | B2 * | 6/2005 | Haas et al. | 123/90.16 |
| 6,923,151 | B2 * | 8/2005 | Kreuter | 123/90.16 |
| 7,174,869 | B2 * | 2/2007 | Proschko et al. | 123/90.39 |
| 7,201,126 | B1 * | 4/2007 | Seitz | 123/90.39 |
| 7,318,402 | B2 * | 1/2008 | Harman et al. | 123/90.39 |
| 7,921,821 | B2 * | 4/2011 | Rorig et al. | 123/90.44 |
| 2001/0023675 | A1 * | 9/2001 | Lee et al. | 123/90.18 |
| 2007/0039573 | A1 * | 2/2007 | Deierlein | 123/52.1 |
| 2007/0101958 | A1 * | 5/2007 | Seitz | 123/90.16 |
| 2008/0295789 | A1 * | 12/2008 | Manther et al. | 123/90.45 |

FOREIGN PATENT DOCUMENTS

| | | |
|---|---|---|
| DE | 10345307 | 4/2005 |
| DE | 102006023772 | 11/2007 |
| JP | 362167860 A * | 7/1987 |

OTHER PUBLICATIONS

Abstract translation of JP362167860A.*

* cited by examiner

*Primary Examiner* — Thomas Denion
*Assistant Examiner* — Steven D Shipe
(74) *Attorney, Agent, or Firm* — Lucas & Mercanti, LLP; Klaus P. Stoffel

(57) ABSTRACT

A switchable cam follower of a valve train of a combustion engine, which has an external lever that encompasses an internal lever. The levers are pivotably moveable relative to one another at a valve-side end. The cam follower has a stop for a gas exchange valve on an underside on the valve-side end and a complementary face on the other end for a support element. The cam follower has a start face on an upper side for at least one high-lift cam. In one receptacle of the internal lever a coupling element is seated, which is displaceable longitudinally and can be brought into engagement in sections in case of coupling with a driving surface of the external lever. Also, at least one torsion is clamped between the two levers.

20 Claims, 3 Drawing Sheets

SWITCHABLE CAM FOLLOWER OF A VALVE TRAIN OF AN INTERNAL COMBUSTION ENGINE

This Application claims the priority of U.S. Provisional Application No. 61/161,679, filed Mar. 19, 2009 and incorporates the same by reference herein.

FIELD OF THE INVENTION

The invention relates to a switchable cam follower of a valve train of an internal combustion engine, with an external lever which is encompassing an internal lever between its arms, which levers are pivotably moveable relative to one another on an axis that is applied to a valve-side end, wherein the cam follower has a stop for a gas-exchange valve on an underside on the valve-side end and on the other end has a complementary face for a support element, wherein the cam follower has a start face on an upper side for at least one high-lift cam, wherein in a receptacle of one of the cams a coupling means is seated, which can be brought into engagement in sections in case of coupling (high-lift) with a driving surface of the respective other lever and wherein at least one torsion spring is clamped between the two levers as lost motion spring.

BACKGROUND OF THE INVENTION

A cam follower of this kind, in this case embodied as a lift deactivation means, is already known from U.S. Pat. No. 5,544,626. The torsion springs of which extend on the valve-side end of the cam follower. As a result of the application of the torsion spring on the one end, a relatively high mass moment of inertia is present. Also, unnecessary installation space is utilized which is essentially outside of the geometry of the cam follower.

Further switchable cam followers with torsion spring on the valve-side end emerge from, for example, DE 103 45 307 A1 and DE 10 2006 023 772 A1.

Although the at least one start face for the cam could, in the embodiments according to the state of the art mentioned above, be displaced further in the direction of the support element, in order to provide a contribution for the lowering of the mass moment of inertia. On the other hand, at the same time, the leverage forces would be drastically increased when the cam is activated. Therefore, a "central" position of the respective start face presents a good compromise.

OBJECT OF THE INVENTION

It is therefore the object of the invention, to develop a switchable cam follower of the kind mentioned above, in which the mentioned disadvantages are eliminated. In particular, a cam follower is to be developed, whose mass moment of inertia is reduced in a design that is simple at the same time.

INVENTIVE SOLUTION

According to the invention, this object is achieved in that the respective torsion spring is seated on an axle journal, which extends in a region of a longitudinal section of the cam follower situated in the immediate vicinity of the complementary face.

Consequently, a switchable cam follower is available, in which the disadvantages mentioned in the outset are eliminated. The mass of the at least one torsion spring no longer affects the mass moment of inertia of the cam follower so as to increase it unnecessarily.

According to a particularly preferred embodiment, exactly two axle journals are provided, which protrude, for example, from an outer side wall of the internal lever or above the complementary face. Every axle journal is encompassed by a torsion spring or a torsion spring packet. Alternatively, a "continuous" axle is conceivable and provided.

In an implementation of the invention, it is proposed to form the respective axle journal either as a separate component or so that it protrudes in one piece from the corresponding side wall (outer side wall of the internal lever/inner side wall of the external lever). A multi-part design is expedient, for example, if the corresponding lever element is manufactured from a lightweight construction material such as sheet steel. If the lever element is to be formed in a casting process or the like, the respective axle journal may be an integral part of the corresponding side wall.

Likewise it is advantageous to design the external lever in a box-like fashion, so that its side walls encompass the axle journals from the side, and in the region of the other end, in front of the rear end of the internal lever, merges into a bracket. The preferably two torsion springs therefore proceed inside of the extension of the cam follower. At the same time, a particularly rigid external lever is present, which may be minimized with respect to its mass.

Further subclaims refer to expedient forms of abutment of the limbs of the respective torsion spring. According to one variation, a first limb of the torsion spring is to extend in a recess of the bracket of the external lever on the other side, whereas according to a further variation, the first limb of the torsion spring engages under the start face on the external lever, which start face is embodied as a wing-like pad. For the abutment of the other limb of the torsion spring, it is provided that a one-piece or multi-part shoulder or the like is protruding from the inner sidewall of the internal lever, against which the other limb is acting.

The pad mentioned above acting as a start face on the external lever may extend from its upper side in the shape of a wing, or point to the inside in the direction of a longitudinal center plane of the cam follower. Preferably, this pad (per arm of the external lever) should be an integral part of the external lever and be appropriately provided, for wear protection, with applied layers and/or measures for heat treatment.

According to a further implementation of the invention, the cam follower is designed as a so-called "lift switch". The external lever of said lift switch, for example, has two pads (sliding surfaces) as stop faces for the cam for associated high-lift cams, whereas for a stop face for the low-lift cam, a rotatable roller mounted on a bearing is provided in the internal lever. If appropriate, in both cases pads or rollers may be provided or the internal lever may have a pad and the external lever have rollers. The extent of protection of the invention, however, also refers to a cam follower which functions as a so-called "lift deactivation means".

A further sub-claim refers to a functional embodiment and arrangement of the coupling means. Accordingly, said coupling means is to be formed as a slider, which is seated in the internal lever preferably above the complementary face which is embodied as a spherical cap and which coupling means is, in the case of coupling, engageable with a driving surface of an end-side bracket of the external lever. The arrangement of the coupling means in the region of the spherical cap and, therefore, of the pivot center of the cam follower is a further contribution to the lowering of the mass moment of inertia. The coupling means may be, for example, a piston, whose engaging section may be cylindrical or flattened.

It is further provided in a development of the invention, to provide a stop for the external lever on the internal lever, so that, for instance, a flush position of the receptacle for the coupling means with respect to the driving surface or, at least, a simple rotation stop is given. An attachment, which is projecting from an upper end side of the internal lever, is provided for the stop, the underside of which attachment communicating with an upper side of the bracket on the end side of the external lever, in the case of engagement.

Although a spherical cap-shaped molding on the underside of the internal lever is particularly expedient as a complementary surface for the support element, it is also conceivable and provided to apply a joint or the like in this area. At this point, it is appropriate to feed hydraulic fluid for the "actuation" of the coupling means from the support element via the spherical cap-like molding in at least one displacement direction.

SHORT DESCRIPTION OF THE DRAWING

The invention is expediently explained by means of the drawing, in which.

DETAILED DESCRIPTION OF THE DRAWING

Figure 1:
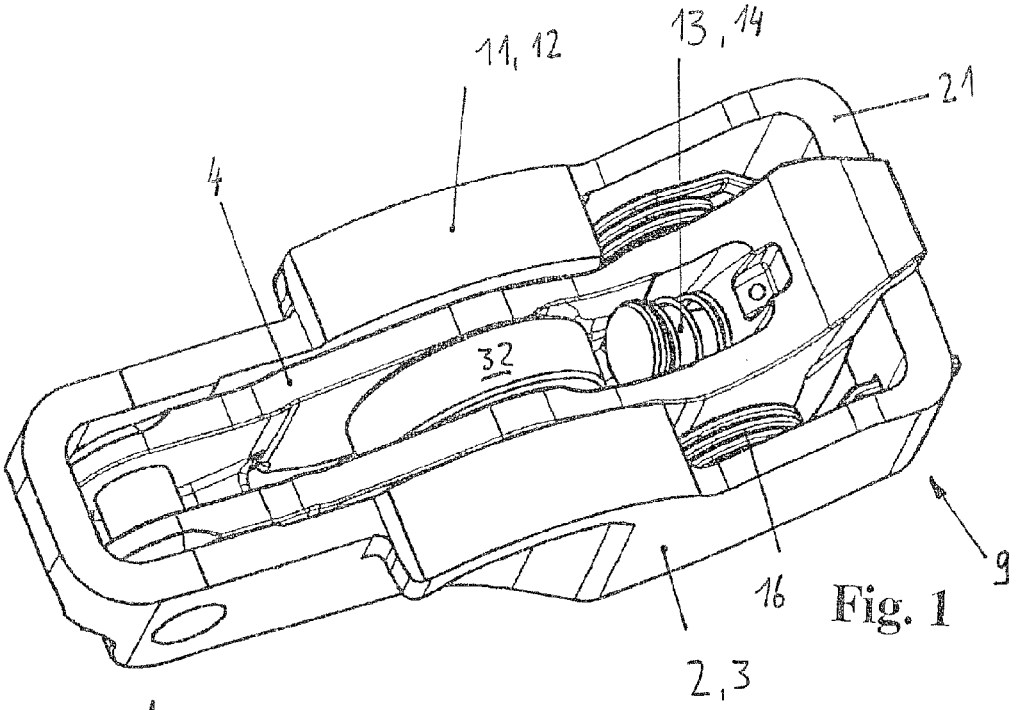
FIG. 1 shows a spatial top view of the switchable cam follower.
Figure 2:
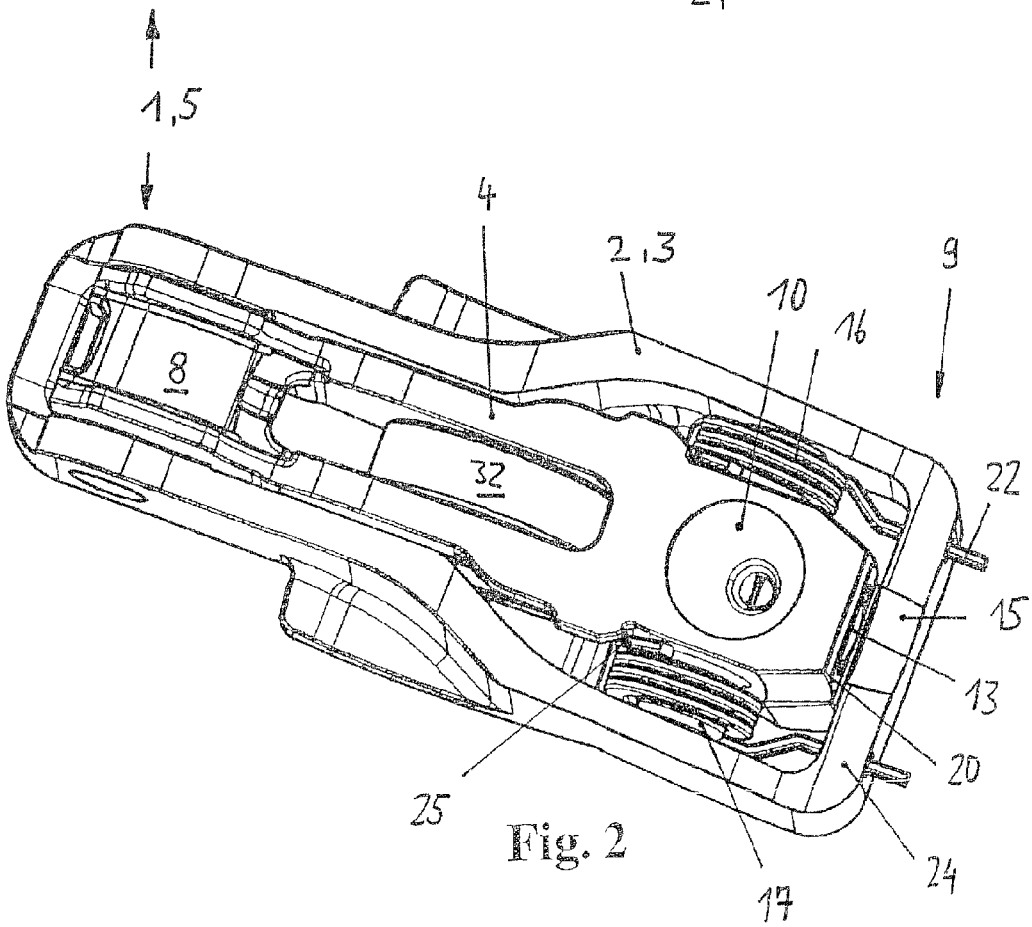
FIG. 2 shows a spatial bottom view of the of the cam follower according to FIG. 1.
Figure 3:
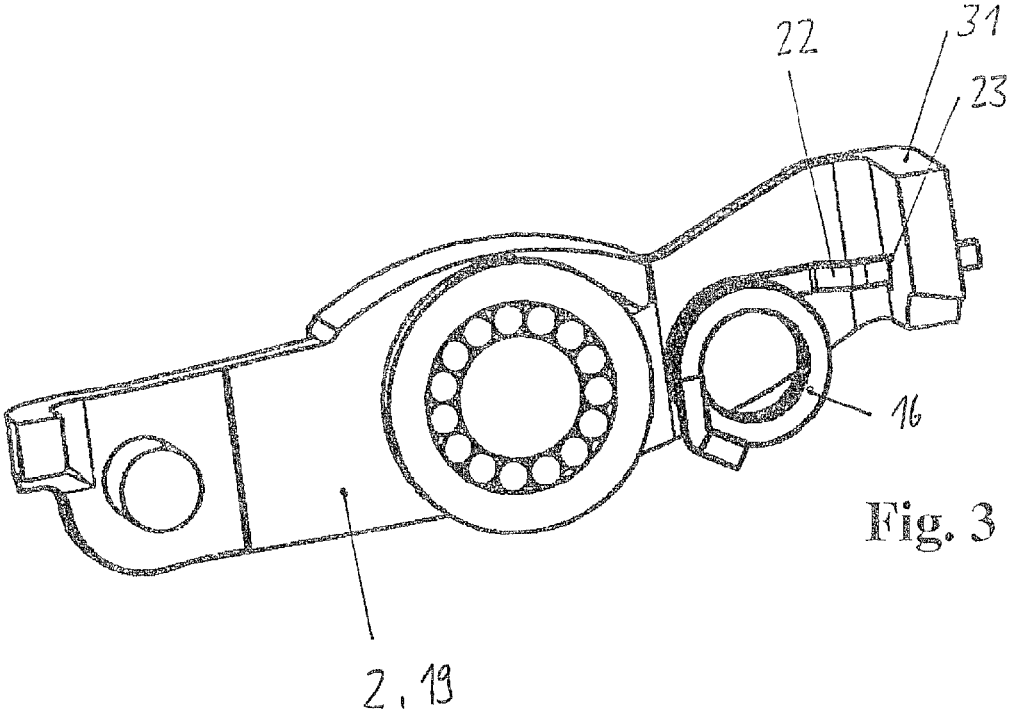
FIG. 3 shows a view of the inner side wall of the external lever of the cam follower mentioned above.

A switchable cam follower 1 in box construction is shown. The cam follower 1 comprises an elongate external lever 2, which encloses between its arms 3 an internal lever 4 pivotably movable relative to it. Both levers 2, 4 are mounted in the region of a valve-side end 5 on a mutual axis 6.

The internal lever 4 has on its underside 7 at the valve-side end 5 a stop 8 for a gas-exchange valve. On the other end 9, the internal lever 4 has a complementary face 10 embodied as spherical cap here, for mounting on a head of a hydraulic support element. Approximately in the region of a longitudinal center, the arms 3 of the external lever 2 have a start face 12 (sliding surface) embodied as a pad for associated high lift cams. The internal lever, in turn, which is also formed from two enlongate arms, has a roller mounted on a roller bearing or a plain bearing as a start face 32 for a low-lift cam.

The internal lever 4 has a receptacle 13 extending in the longitudinal direction above the complementary face 10 for a piston serving as coupling means 14. The latter is displaceable in sections in case of coupling under a driving surface 15 of a bracket 21 which connects the arms 3 of the external lever 2 at the other end 9. In case of coupling, lift of the high-lift cam is transmitted, as is known to a person skilled in the art, which cam is contacting the arms 3 of the external lever 2, wherein in case of decoupling, only the internal lever 4 is active and the gas exchange valve opens in terms of the low-lift cam contacting the internal lever 4.

Two torsion springs are provided as lost-motion spring means 16. For the mounting of which torsion springs one axle journal 17 per outer side wall 18 of the internal lever 4 is protruding in the longitudinal section region of the complimentary face 10. The axle journal 17 may be a one-part or multi-part component of the respective outer side wall 18. Outer ends of the axle journal 17 are covered by the arms 3 of the external lever 2. Therefore, the torsion springs 16 extend inside the extension of the cam follower 1.

According to the embodiment in FIGS. 1 to 4, one limb 22 of the corresponding torsion spring 16 is seated in a recess 23 of the bracket 21 mentioned above. In order to mount a further limb 25 of the torsion spring 16, a shoulder 26 is protruding from the inner side wall 19 of the corresponding arm 3 of the external lever 2, against which shoulder 25 the other limb is supported.

Figure 5:
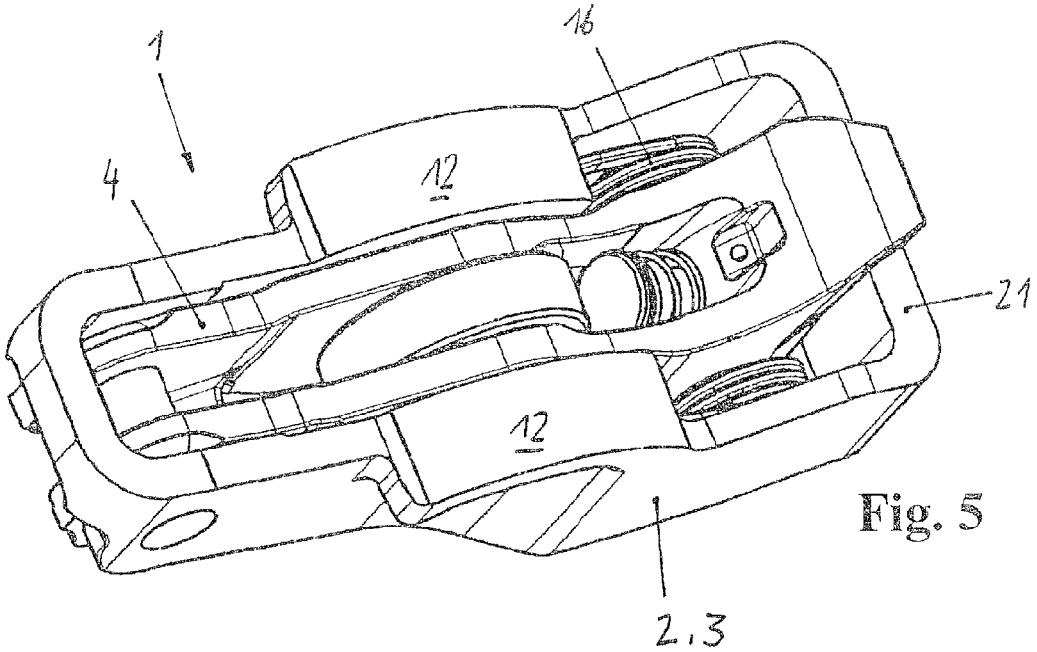
FIG. 5 shows a spatial view of a further switchable cam follower, similar to the one disclosed in FIG. 1, but with modifications in the region of the abutments for the torsion spring.
Figure 6:
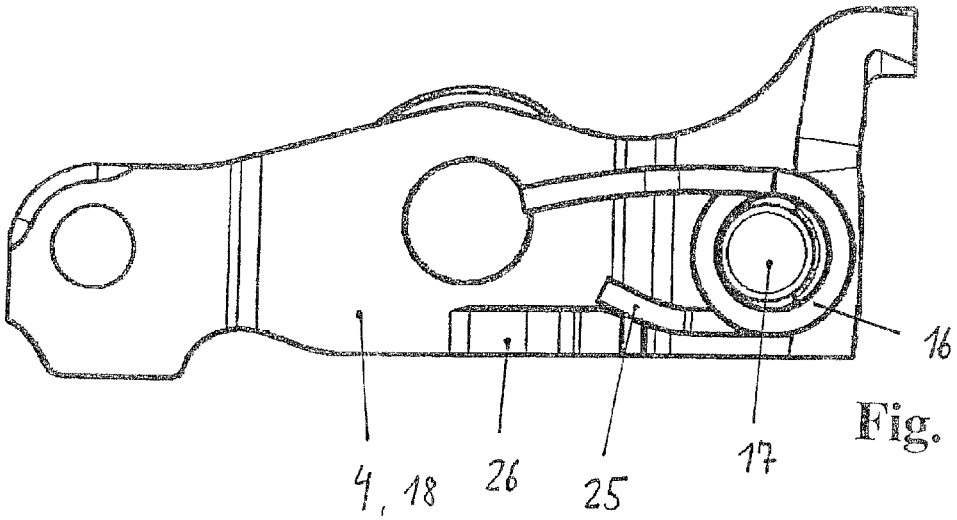
FIG. 6 shows a side view of an outer side wall of the internal lever according to FIG. 5.
Figure 7:
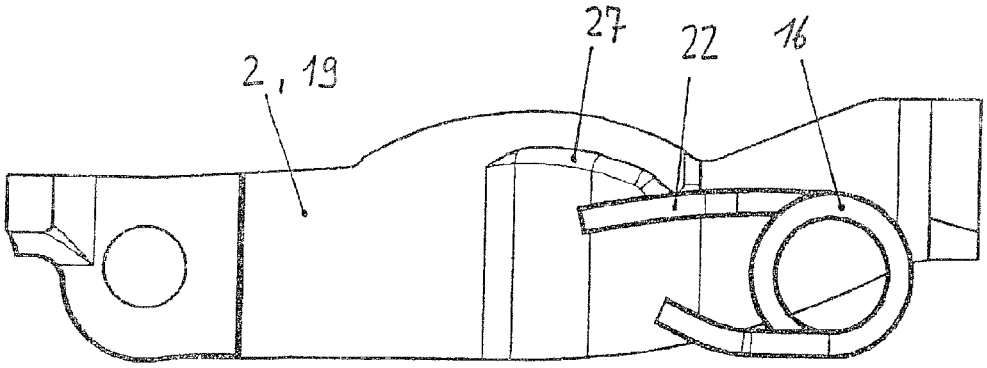
FIG. 7 shows a view of the inner side wall of the external lever according to FIG. 5.

As an alternative (see FIGS. 5 to 7), the first limb 22 of the respective torsion spring 16 is acting against an underside 27 of the start face 12, which is protruding in a wing-like fashion on the external lever 2. The other limb 25 is in turn supported against the shoulder 26, which is protruding from the inner side wall 19 of the arm 3 of the external lever 2. As can be seen, in particular, from FIGS. 6, 7, both limbs 22, 25 of the torsion spring therefore point to the valve-side end.

Figure 4:
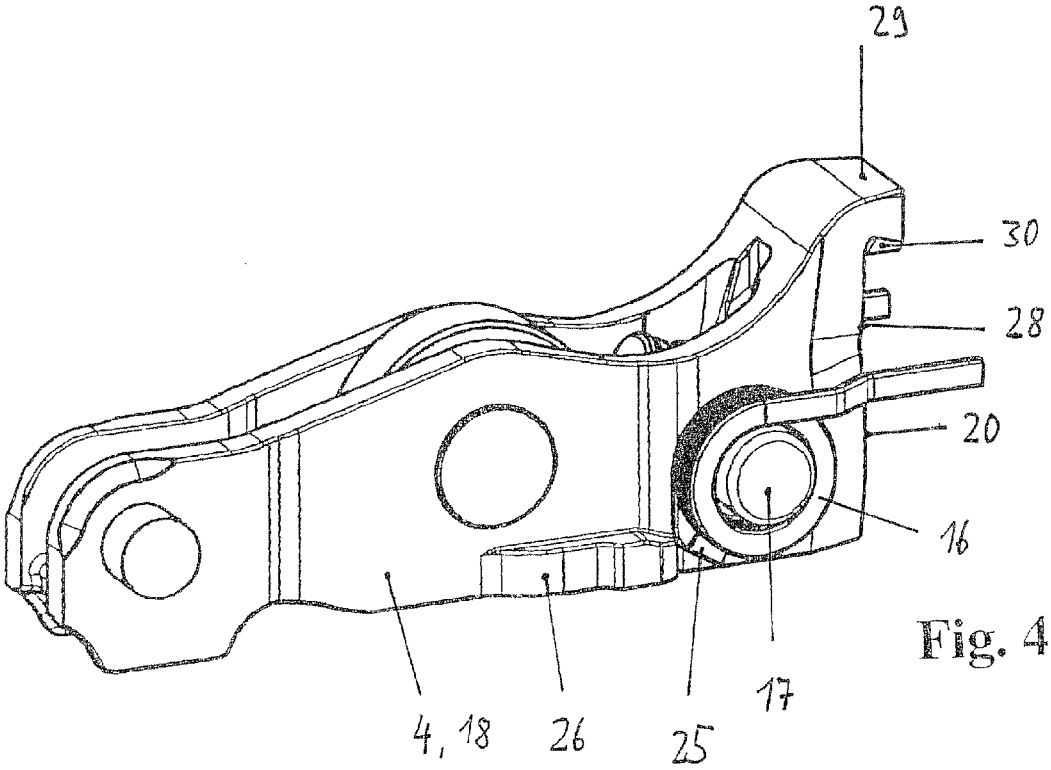
FIG. 4 shows a spatial view of the internal lever of the cam follower mentioned above.

As FIG. 4, for instance, discloses, an extension 29 extends from an upper side 28 of the end 20 of the internal lever 4 in the direction remote from the lever. The external lever 2 rests with an upper side 31 of its bracket 21 on an underside 30 of the extension 29, in order to create a flush coupling position of the receptacle 13 with respect to the driving surface 15 or to just create a rotation stop.

Because of the arrangement of the torsion springs 16 in the immediate region of a pivot center of the cam follower 1, the cam follower has only a relatively low mass moment of inertia.

LIST OF REFERENCE NUMBERS

1) Cam follower
2) External lever
3) Arm
4) Internal lever
5) Valve-side end
6) Axis
7) Underside
8) Stop gas exchange valve
9) Other end
10) Complementary face
11) Upperside
12) Start face
13) Receptacle
14) Coupling means
15) Driving surface
16) Torsion spring (Lost-motion spring)
17) Axle journal
18) Outer side wall internal lever
19) Inner side wall
20) End internal lever
21) Bracket
22) First limb
23) Recess
24) Underside bracket
25) Other limb
26) Shoulder
27) Underside pad

28) Upper side end
29) Extension
30) Underside extension
31) Upper side bracket
32) Contact surface

The invention claimed is:

1. A switchable cam follower of a valve train of a combustion engine, comprising:

an internal lever;

an external lever having arms that encompass the internal lever, the internal lever and the external lever being pivotably moveable relative to one another on an axis of rotation at a valve-side end of the cam follower;

a stop for a gas exchange valve on an underside of the cam follower at the valve-side end of the cam follower;

a complementary face for a support element on the underside of the cam follower at another end of the cam follower;

a start face on an upper side of the cam follower for at least one high-lift cam;

an axle journal extending transverse to the internal lever and the external lever, in a region of a longitudinal section of the cam follower that is spaced from the another end of the cam follower and in a vicinity of the complimentary face; and at least one torsion spring, which is a lost motion spring, seated on the axle journal and clamped between the internal lever and the external lever, wherein one of the levers has a receptacle and a coupling means is seated in the receptacle, another of the levers has a driving surface, and the coupling means is engagable in sections when coupled with the driving surface of the another of the levers, wherein the axle journal protrudes from an outer side wall of the internal lever or from an inner side wall of one of the arms of the external lever, above or lateral of the complementary face, wherein the arms of the external lever encompass the axle journal lengthwise to form a bracket behind an end of the internal lever at the another end of the cam follower, and wherein the bracket of the external lever has a recess and the internal lever has an outer side wall with a shoulder located behind the axle journal as viewed from the another end of the cam follower toward the valve-side end of the cam follower, and the torsion spring has a first limb and a second limb, the first limb is seated either in the recess of the bracket or acts on an underside of the bracket and the second limb of the torsion spring acts against the shoulder of the outer side wall of the internal lever.

2. The cam follower of claim 1, wherein exactly two torsion springs are provided as a lost-motion spring, the two axle joints of which are arranged on opposite sides of the longitudinal center plane of the cam follower.

3. The cam follower of claim 1, wherein the axle journal is connected in one piece with the cam follower.

4. The cam follower of claim 1, wherein the axle journal is formed as a separate component from the cam follower.

5. The cam follower of claim 1, wherein the coupling means includes at least one slider seated in the receptacle, and the receptacle extends in a longitudinal direction in the internal lever above or lateral to the complementary face to an end side of the internal lever at the another end, wherein the external lever encompasses the end side of the internal lever by way of a bracket that connects the arms of the external lever, and wherein the driving surface for the coupling means is either a partially cylindrical molding on an underside of the bracket or a bore or complimentary opening in the bracket.

6. The cam follower of claim 5, wherein a finger extension protrudes from an upper side of the end side of the internal lever in the longitudinal direction of the internal lever, and the extension has an underside against which an upper side of the bracket of the external lever abuts in the event of cam base circle passage.

7. The cam follower of claim 1, wherein the stop for the gas exchange valve and the complementary face for the support element are assigned to the internal lever.

8. The cam follower of claim 1, wherein the cam follower is a lift switch, wherein both arms of the external lever are each contactable by a high-lift cam and the internal lever by a low-lift cam.

9. The cam follower of claim 8, wherein a pad is provided as the start face on at least one of the arms of the external lever, which start face protrudes from a surface of the arm, and wherein the internal lever has a roller as a contact surface.

10. The cam follower of claim 1, wherein the complementary face for the support element is formed as a hemispherical cap in an underside of the internal lever, the cam follower is mountable on a head of the support element via the cap, wherein the support element is hydraulic, via which head hydraulic fluid can be led into the internal lever to displace the coupling means.

11. A switchable cam follower of a valve train of a combustion engine, comprising an internal lever;

an external lever having arms that encompass the internal lever, the internal lever and the external lever being pivotably moveable relative to one another on an axis of rotation at a valve-side end of the cam follower;

a stop for a gas exchange valve on an underside of the cam follower at the valve-side end of the cam follower;

a complementary face for a support element on the underside of the cam follower at another end of the cam follower;

a start face on an upper side of the cam follower for at least one high-lift cam;

an axle journal extending transverse to the internal lever and the external lever, in a region of a longitudinal section of the cam follower that is spaced from the another end of the cam follower and in a vicinity of the complimentary face; and at least one torsion spring, which is a lost motion spring, seated on the axle journal and clamped between the internal lever and the external lever, wherein one of the levers has a receptacle and a coupling means is seated in the receptacle, another of the levers has a driving surface, and the coupling means is engagable in sections when coupled with the driving surface of the another of the levers, and wherein the torsion spring has a first limb and a second limb that both extend toward the valve-side end of the cam follower, wherein the external lever has a contact surface that protrudes from a surface of the external lever and the first limb acts against an underside of the contact surface, and wherein the internal lever has an outer side wall with a shoulder and the second limb is supported against the shoulder of the outer side wall of the internal lever.

12. The cam follower of claim 11, wherein exactly two torsion springs are provided as a lost-motion spring, the two axle journals of which are arranged on opposite sides of a longitudinal center plane of the cam follower.

13. The cam follower of claim. 11, wherein the axle journal is connected in one piece with the cam follower.

14. The cam follower of claim 11, wherein the axle journal is formed as a separate component from the cam follower.

15. The cam follower of claim 11, wherein the coupling means includes at least one slider seated in the receptacle, and the receptacle extends in a longitudinal direction in the internal lever above or lateral to the complementary face to an end side of the internal lever at the another end, wherein the external lever encompasses the end side of the internal lever by way of a bracket that connects the arms of the external lever, and wherein the driving surface for the coupling means is either a partially cylindrical molding on an underside of the bracket or a bore or complimentary opening in the bracket.

16. The cam follower of claim 15, wherein a finger extension protrudes from an upper side of the end side of the internal lever in the longitudinal direction of the internal lever, and the extension has an underside against which an upper side of the bracket of the external lever abuts in the event of cam base circle passage.

17. The cam follower of claim 11, wherein the stop for the gas exchange valve and the complementary face for the support element are assigned to the internal lever.

18. The cam follower of claim 11, wherein the cam follower is a lift switch, wherein both arms of the external lever are each contactable by a high-lift cam and the internal lever by a low-lift cam.

19. The cam follower of claim 18, wherein a pad is provided as the start face on at least one of the arms of the external lever, which start face protrudes from a surface of the arm, and wherein the internal lever has a roller as a contact surface.

20. The cam follower of claim 11, wherein the complementary face for the support element is formed as a hemispherical cap in an underside of the internal lever, the cam follower is mountable on a head of the support element via the cap, wherein the support element is hydraulic, via which head hydraulic fluid can be led into the internal lever to displace the coupling means.

* * * * *